United States Patent [19]

Brusselle

[11] 4,210,295

[45] Jul. 1, 1980

[54] CABLE CLAMP FOR FASTENING A CABLE ONTO A CABLE SPOOL

[76] Inventor: André Brusselle, Kemmelbergstraat 33, Oostende, Belgium

[21] Appl. No.: 936,128

[22] Filed: Aug. 23, 1978

[30] Foreign Application Priority Data

Aug. 23, 1977 [BE] Belgium ..... 0180374

[51] Int. Cl.[2] ..... B65H 75/28

[52] U.S. Cl. ..... 242/125.1

[58] Field of Search ..... 242/125.1, 125.2, 125, 242/100, 117, 86

[56] References Cited

U.S. PATENT DOCUMENTS

| | | | |
|---|---|---|---|
| 2,193,407 | 3/1940 | Hagen | 242/117 |
| 2,420,594 | 5/1947 | Hall | 242/125.2 |
| 2,421,788 | 6/1947 | Henry | 242/117 |
| 3,051,446 | 8/1962 | Nelson et al. | 242/125.1 X |

*Primary Examiner*—George F. Mautz

*Attorney, Agent, or Firm*—Haseltine, Lake & Waters

[57] ABSTRACT

The invention relates to a cable clamp for fastening a cable onto a cable spool. The side of a spool is connected to a central tubular member and a clamp of square or similar section having a surface approximately equal to the diameter of the cable is disposed in working relation to the cable. A slot is formed of the clamp slightly larger than the diameter of the cable strand and has a length approximately equal to the size of the cable clamp. Screws are provided to extend through to the clamp interior for urging the cable in position with respect of the spool.

5 Claims, 2 Drawing Figures

CABLE CLAMP FOR FASTENING A CABLE ONTO A CABLE SPOOLBACKGROUND OF THE INVENTION

Numerous means for fastening a cable to a cable spool are known in the art.

However, a great number of these constructions give rise to difficulties of which a brief summary will be given below.

If a cable is made to pass through an opening fashioned in the side of a spool at the level of a central tubular member and when fastened to the other side of this member by means of a clamp, deficiencies result in the assembly of the side to the tube of the spool. To overcome this problem a reinforcement must be adapted around this opening and on the surface where the cable clamp is located. Moreover, principally in the case of large diameter cables, this solution causes difficulties when it necessitates the cable to pass through the side of the spool.

If this principle is abandoned and if the cable is fastened to the spool by means of a hook provided with a bolt and nut end surrounding the cable, during winding a localized problem is created that is found in all of the wound layers which can give rise to great difficulties for the guiding mechanism of the cable in the cable spool.

SUMMARY OF THE INVENTION

It is the main object of the invention to overcome the defects of the prior art. It is another object of the present invention to provide not only a simple construction, but to avoid the inconveniences summarized above.

In accordance with the invention a square or similar block is employed whose surface has the same dimensions as the diameter of the cable to be attached and a longitudinal slot is made slightly wider than the diameter of a cable strand.

The cable, which is bound at its end and of which one or several strands pass with a length approximately equal to that of the cable clamp, is pressed between the tube member of the spool and the disposed thereabove block by means of recessed pressure screws. This clamp is in turn welded to the tube and to the side of the spool, thus producing a solid assembly between the cable and the spool.

When wieved in transverse section, the dimensions of the clamp are approximately equal to the diameter of the cable and no defects are produced. During winding for cables of great diameter, a bushing is disposed, behind the cable clamp, filling the dead space formed at the transition between the first and the second layer of cable at the level of the clamp. Moreover, the present invention offers a substantial advantage due to the fact that no obstables intervene in the assembly of the cable spool, since the cable does not traverse either in the tube of the spool, or in its side.

In order to better illustrate this method, reference is made to the attached drawings given purely and simply by way of information and not limiting the description of the present invention.

DESCRIPTION OF THE PREFERRED EMBODIMENT

Figure 1:
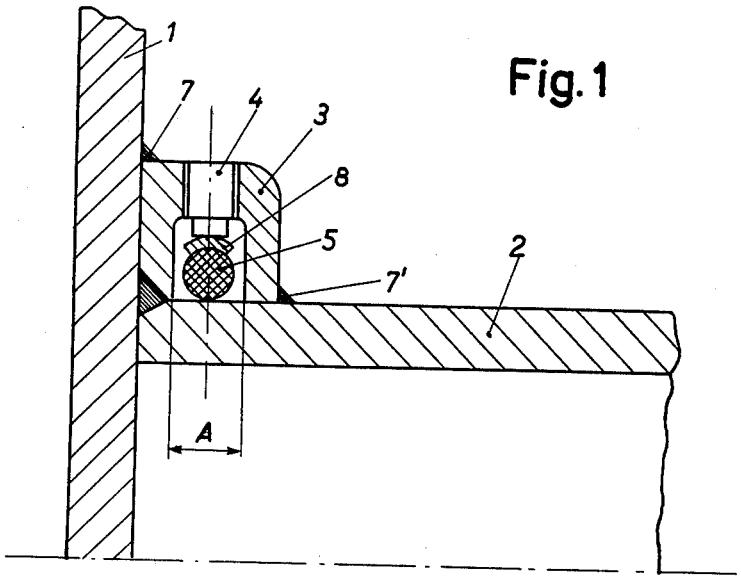
FIG. 1 is a transverse section of the cable clamp according to the invention with a strand, the section being taken along the line I—I of FIG. 2.
Figure 2:
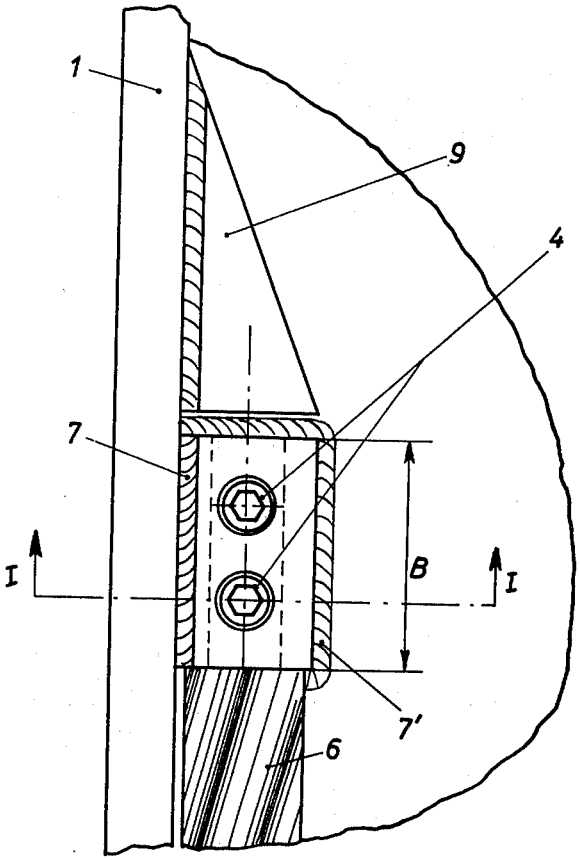
FIG. 2 is a partial view from the top of the clamp with the cable.

Reference numeral 1 shows the side of the spool which is assembled to central tube 2 in a known manner. A clamp 3 of square or similar shape has a surface approximately the same dimensions as the diameter of cable 6. A slot is made of width A slightly larger than the diameter of strand 5 having a length approximately equal to dimension B of the cable clamp. In turn, the cable clamp 3 is assembled to the side 1 and to the tube 2 of the spool by spot welding at 7 and 7'.

By means of pressure-screws 4 recessed in the clamp 3 and protection plate 8, the strand 5 of the cable 6 is pressed between the cable clamp 3 and the tube 2 of the cable spool, thus ensuring a solid assembly between the cable 6 and the spool.

Bushing 9 of the same height as the cable clamp can, in the case of cables of great diameter, be placed behind the clamp 3 in order to neutralize the dead space between the first and second layer of cable.

The cable clamp described above is of a very simple construction and requires a minimum of operation.

In summary, the invention described above ensures an extremely simple, economic and viable form of production, whilst enabling to place a cable on a spool without difficulty.

While the present invention has been particularly described in terms of specific embodiments thereof it will be understood that in view of the present disclosure numerous deviations therefrom and modifications thereupon may be readily devised by those skilled in the art.

I claim:

1. A cable clamp assembly for use with winches having a spool on which a cable made from several strands is wound, said spool being provided with a flange at each end thereof, wherein, said clamp assembly is secured to the spool and to an inner face of said flange, said clamp assembly comprises : a body; a longitudinal slot formed in said body for receiving the cable and means recessed in the body and terminating within said slot cooperating with the body for pressing said cable between the spool and the clamp assembly.

2. A clamp assembly according to claim 1, wherein: said slot has a length equal to that of the clamp assembly body and a width larger than the size of one strand of the cable.

3. A clamp assembly according to claim 1, wherein: the clamp assembly body is welded to said spool and said flange.

4. A clamp assembly according to claim 1, wherein: said means for pressing said cable include screws, and a protection plate is disposed above said cable to allow said screws to bear against said protection plate when said screws are tightened.

5. A clamp assembly according to claim 1, wherein: bushing means are disposed on said spool behind the clamp assembly for co-action with respective layers of cable would onto said spool.

* * * * *